US011518636B2

(12) United States Patent
Oishi et al.

(10) Patent No.: US 11,518,636 B2
(45) Date of Patent: Dec. 6, 2022

(54) SHEET TRANSPORT DEVICE AND IMAGE FORMING APPARATUS

(71) Applicant: FUJIFILM Business Innovation Corp., Tokyo (JP)

(72) Inventors: Ryuga Oishi, Kanagawa (JP); Takuyoshi Kimura, Kanagawa (JP); Yasunobu Goto, Kanagawa (JP); Takehiko Koizumi, Kanagawa (JP); Natsumi Nakata, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 316 days.

(21) Appl. No.: 16/836,936

(22) Filed: Apr. 1, 2020

(65) Prior Publication Data

US 2021/0107755 A1 Apr. 15, 2021

(30) Foreign Application Priority Data

Oct. 15, 2019 (JP) ..... JP2019-188294

(51) Int. Cl.
*B65H 5/36* (2006.01)
*B65H 15/00* (2006.01)
(Continued)

(52) U.S. Cl.
CPC ..... *B65H 15/00* (2013.01); *B65H 5/36* (2013.01); *B65H 9/06* (2013.01); *B65H 45/04* (2013.01); *B65H 2301/3113* (2013.01); *B65H 2301/3331* (2013.01); *B65H 2404/144* (2013.01); *B65H 2511/20* (2013.01); *B65H 2801/06* (2013.01)

(58) Field of Classification Search
CPC ... B65H 5/36; B65H 9/06; B65H 9/08; B65H 2301/4423; B65H 2301/312; B65H 2301/31122; B65H 2301/321; B65H 2301/5121; B65H 2301/5122
See application file for complete search history.

(56) References Cited

U.S. PATENT DOCUMENTS 6,331,004 B1 * 12/2001 Katou ..... G03G 15/231 271/301
8,366,099 B2 * 2/2013 Cook ..... B65H 7/02 271/301

(Continued)

FOREIGN PATENT DOCUMENTS

JP 2015049571 A * 3/2015 ..... G07D 11/0018
JP 2017142365 8/2017

*Primary Examiner* — Howard J Sanders
(74) *Attorney, Agent, or Firm* — JCIPRNET

(57) ABSTRACT

A sheet transport device includes a sheet storage unit that stores a sheet and that is disposed in a housing having a bottom plate such that a gap is provided between the sheet storage unit and the bottom plate, the gap extending horizontally; a sheet transport unit that feeds the sheet from the sheet storage unit and transports the fed sheet along a transport passage including a reversing transport path along which the sheet is transported downward and then upward to reverse the sheet front to back, the reversing transport path extending vertically and being connected to the gap; and a first gate unit that prevents passage of the sheet that has entered the reversing transport path when the sheet free falls and allows passage of the sheet when the sheet receives a sheet transport driving force from the sheet transport unit.

20 Claims, 7 Drawing Sheets

(51) Int. Cl.
*B65H 9/06* (2006.01)
*B65H 45/04* (2006.01)

(56) References Cited

U.S. PATENT DOCUMENTS

| | | | | |
|---|---|---|---|---|
| 10,183,835 | B2 | 1/2019 | Kakita | |
| 11,001,469 | B2 * | 5/2021 | Nakamura | G03G 21/1638 |
| 2017/0225917 | A1 * | 8/2017 | Kakita | B65H 85/00 |

* cited by examiner

SHEET TRANSPORT DEVICE AND IMAGE FORMING APPARATUS

CROSS-REFERENCE TO RELATED APPLICATIONS

This application is based on and claims priority under 35 USC 119 from Japanese Patent Application No. 2019-188294 filed Oct. 15, 2019.

BACKGROUND

(i) Technical Field

The present disclosure relates to a sheet transport device and an image forming apparatus.

(ii) Related Art

Image forming apparatuses that feed sheets from a sheet tray and form images on both sides of the sheets are known. Such an image forming apparatus may form images on both sides of long sheets. To form images on both sides of a sheet, the sheet needs to be reversed after an image is formed on a front side thereof. Therefore, when images are to be formed both sides of a long sheet, a space having a length corresponding to the length of the long sheet is required to enable reversal of the sheet. A gap below the sheet tray may be used as this space. Even when the specifications of an image forming apparatus are such that the image forming apparatus is capable of forming images on both sides of long sheets, sheets of normal lengths are often used, and sheets of shorter lengths may also be used. One of the problems of such an image forming apparatus is how to prevent short sheets that are being subjected to an image forming operation from becoming separated from a sheet transport mechanism by accident and slipping into the gap below the sheet tray.

Accordingly, Japanese Unexamined Patent Application Publication No. 2017-142365 proposes a gate mechanism disposed at an intermediate position of a sheet transport path connected to a gap below a sheet tray. The gate mechanism includes a gate that is opened manually or by a solenoid only when images are to be formed on both sides of a long sheet.

SUMMARY

Aspects of non-limiting embodiments of the present disclosure relate to a sheet transport device and an image forming apparatus including a gate structure that does not need to be opened or closed and that prevents a sheet that has been separated from a sheet transport mechanism from sliding into a gap.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a sheet transport device including a sheet storage unit that stores a sheet and that is disposed in a housing having a bottom plate such that a gap is provided between the sheet storage unit and the bottom plate, the gap extending horizontally; a sheet transport unit that feeds the sheet from the sheet storage unit and transports the fed sheet along a transport passage including a reversing transport path along which the sheet is transported downward and then upward to reverse the sheet front to back, the reversing transport path extending vertically and being connected to the gap; and a first gate unit that prevents passage of the sheet that has entered the reversing transport path when the sheet free falls and allows passage of the sheet when the sheet receives a sheet transport driving force from the sheet transport unit.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure will now be described.

Figure 1:
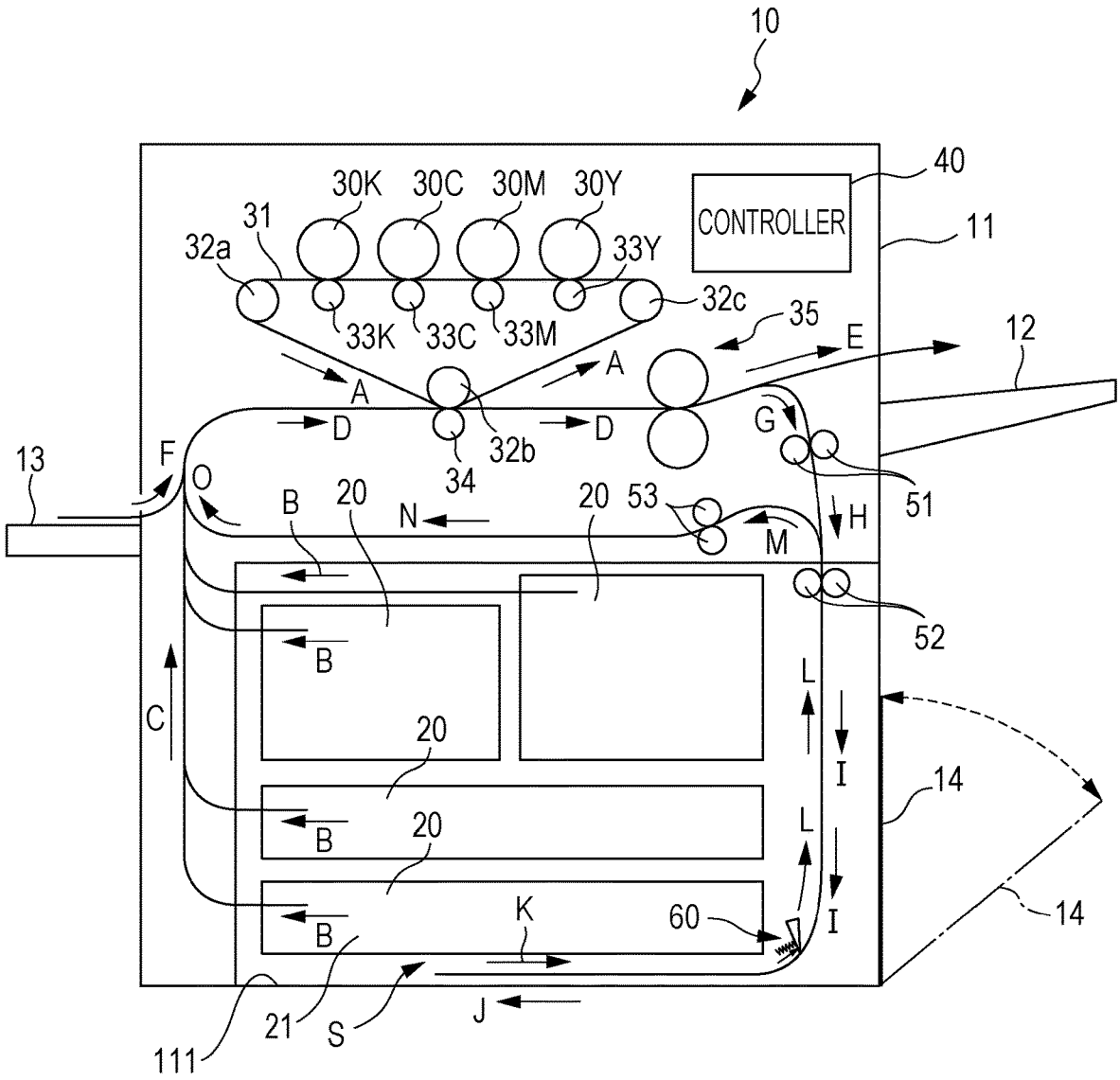
FIG. 1 is a schematic diagram of an image forming apparatus according to an exemplary embodiment of the present disclosure.

FIG. 1 is a schematic diagram of an image forming apparatus according to an exemplary embodiment of the present disclosure. This image forming apparatus includes a sheet transport device according to the exemplary embodiment of the present disclosure.

An image forming apparatus 10 illustrated in FIG. 1 includes four sheet trays 20 disposed in a housing 11. These sheet trays 20 are each capable of being pulled out of the housing 11 in a forward direction that is perpendicular to the plane of FIG. 1 and pushed in a backward direction to be placed in the housing 11. The sheet trays 20 store sheets of different types in a stacked state. The image forming apparatus 10 feeds and transports a sheet stored in a designated one of the sheet trays 20, forms an image on the sheet that has been fed, and discharges the sheet having the image formed thereon to a sheet output tray 12. The transportation of the sheet will be described below.

Four image forming engines 30Y, 30M, 30C, and 30K are disposed in an upper section of the housing 11 of the image forming apparatus 10. The image forming engines 30Y, 30M, 30C, and 30K form toner images by using yellow (Y), magenta (M), cyan (C), and black (K) toners, respectively.

An intermediate transfer belt 31 is disposed directly below the image forming engines 30Y, 30M, 30C, and 30K. The intermediate transfer belt 31 is wrapped around plural rollers 32*a*, 32*b*, and 32*c* and rotates in the direction of arrows A. The toner images of the respective colors formed by the image forming engines 30Y, 30M, 30C, and 30K are successively transferred onto the intermediate transfer belt 31 in a superposed manner by the operations of first transfer devices 33Y, 33M, 33C, and 33K. The toner images that have been transferred onto the intermediate transfer belt 31 are transported by the rotation of the intermediate transfer belt 31, and are transferred onto a sheet transported at a suitable timing by the operation of a second transfer device 34. The toner images that have been transferred onto the sheet are fixed to the sheet by being heated and pressed by a fixing device 35. The sheet on which an image composed of the fixed toner images is formed is finally discharged onto the sheet output tray 12.

The image forming apparatus 10 also includes a controller 40. The controller 40 controls the overall operation of the image forming apparatus 10 including the operations of forming the toner images with the image forming engines 30Y, 30M, 30C, and 30K, transferring the toner images onto the intermediate transfer belt 31, transferring the toner images onto the sheet, and transporting the sheet.

A sheet transport passage will now be described. The sheet transport passage is provided with many transport members including transport rollers or the like and gates for switching the path along which the sheet is transported. However, FIG. 1 only illustrates transport rollers 51, 52, and 53 that are arranged at three locations and that are necessary for the description of the characteristic part of the present exemplary embodiment.

In an image forming operation, a sheet is fed leftward in FIG. 1 in the direction of arrows B from one of the sheet trays 20, and transported upward in the direction of arrow C. Among the sheet trays 20, the lowermost sheet tray 21 corresponds to an example of a sheet storage unit according to the present disclosure.

The sheet transported upward in the direction of arrow C is transported in the direction of arrows D, which is opposite to the direction of arrows B. An image is formed on the sheet while the sheet is being transported in the direction of arrows D.

After the toner images are transferred onto the sheet by the operation of the second transfer device 34 and fixed to the sheet by the operation of the fixing device 35 so that an image composed of the fixed toner images is formed on the sheet, the sheet is transported in the direction of arrow E and discharged onto the sheet output tray 12 if the operation mode is not a double-sided printing mode in which images are to be formed on both sides of the sheet.

The image forming apparatus 10 also includes a manual feed tray 13, and the sheet may also be fed from the manual feed tray 13. When the sheet is to be fed from the manual feed tray 13, the sheet is placed on the manual feed tray 13. The sheet on the manual feed tray 13 is pulled in the direction of arrow F, and is transported in the direction of arrows D. After that, the sheet is transported along the same transport path as that in the case where the sheet is fed from one of the sheet trays 20.

In the double-sided printing mode in which images are formed on both sides of the sheet, the sheet is transported along transport paths described below.

First, an image is formed on a front side of the sheet. Similar to the above-described case, to form an image on the front side of the sheet, the sheet is fed leftward in FIG. 1 in the direction of arrows B from one of the sheet trays 20, transported upward in the direction of arrow C, and then transport in the direction of arrows D. Then, toner images are transferred onto the front side of the sheet that is transported in the direction of arrows D, and fixed so that an image composed of the fixed toner images is formed on the front side of the sheet.

The sheet having the image formed on the front side thereof moves in the direction of arrow G instead of being transported in the direction of arrow E, and is transported downward in the direction of arrow H by the transport rollers 51. Then, the sheet is further transported downward in the direction of arrows I by the transport rollers 52.

The transport rollers 52 are capable of rotating in forward and reverse directions, and start to rotate in the reverse direction while an upper end of the sheet that is transported downward in the direction of arrows I is still above the transport rollers 52. In the case where the sheet used in the current image forming process has a short length in a transporting direction in which the sheet is transported, the sheet is in a position such that the sheet hangs down from the transport rollers 52 when the reverse rotation is started.

In the case where the length of the sheet is greater than the height of the transport rollers 52 from a bottom plate 111 of the housing 11, the sheet is in a position described below.

A gap S is formed between the lowermost sheet tray 21 among the sheet trays 20 disposed in the housing 11 and the bottom plate 111 of the housing 11. The transport path that extends downward from the transport rollers 52 is connected to the gap S. Therefore, the sheet that is long in the transporting direction is transported downward in the direction of arrows I, and a leading end portion of the sheet enters the gap S and is transported in the direction of arrow J.

The transport rollers 52 start to rotate in the reverse direction while the upper end of the sheet that is transported downward is still above the transport rollers 52. Accordingly, when the sheet is long, the lower end portion of the sheet is transported in the direction of arrow K, and then transported upward in the direction of arrows L. Then, the sheet is transported in the direction of arrow M, and then transported by the transport rollers 53 in the direction of arrow N, which is opposite to the direction of arrows D, in a region below the transport path in the direction of arrows D. The transport path according to the present exemplary embodiment along which the sheet is transported in the direction of arrows I and the direction of arrow J and that is connected to the gap S corresponds to an example of a reversing transport path according to the present disclosure. The structure that includes the above-described transport paths including the reversing transport path and that transports the sheet corresponds to an example of a sheet transport unit according to the present disclosure. A gate unit 60 is provided on the reversing transport path at a position slightly above the bottom plate 111 of the housing 11. The gate unit 60 will be described below.

The sheet transported in the direction of arrow N is transported in the direction of arrow O and enters the transport path in the direction of arrows D. By this time, the front and back sides of the sheet are reversed, so that toner images are transferred onto the back side of the sheet when the sheet moves in the direction of arrows D. The toner images that have been transferred onto the back side of the sheet are fixed to the back side of the sheet by the fixing device 35. Thus, images are formed on both front and back sides of the sheet. The sheet having images formed on both sides thereof moves in the direction of arrow E, and is discharged onto the sheet output tray 12.

Assume that a sheet having an image formed on the front side thereof moves in the directions of arrows G, H, and I in the double-sided printing mode and that the upper end thereof passes through the transport rollers 52 and falls in the direction of arrows I. This occurs when, for example, there is a trouble in the sequence, such as a slight delay in starting the reverse rotation of the transport rollers 52, or when the length of the actual sheet is shorter than the length of the designated sheet due to a user error in setting sheets.

As described above, the sheet is transported by the transport rollers 51 in the direction of arrow H, and is received and continuously transported by the transport rollers 52. The transport rollers 52 transport the sheet in the direction of arrows I, and then rotate in the reverse direction to transport the sheet in the direction of arrows L. Then, the sheet is transported in the direction of arrow M, and is received and continuously transported by the transport rollers 53. When the sheet that is used is long, the trailing end of the sheet that is received and continuously transported by the transport rollers 53 may be unable to leave the transport rollers 52 before the leading end of the next sheet that is transported by the transport rollers 51 reaches the transport rollers 52. In this exemplary embodiment, the transport rollers 52 are composed of two rollers that nip the sheet therebetween in a releasable manner. More specifically, when the two rollers are opened so that a gap is provided therebetween, the sheet freely moves through the gap between the rollers. At the time when the trailing end of the previous sheet leaves the transport rollers 52, the next sheet is still transported by the transport rollers 51. After the trailing end of the previous sheet leaves the transport rollers 52, the transport rollers 52 are closed to receive the next sheet from the transport rollers 51 and continuously transport the next sheet in the direction of arrows I. In the present exemplary embodiment, the above-described sequence is used to increase the productivity of the image forming operation. However, since the transport rollers 52 are opened and closed, there may be a higher risk that a sheet will pass through the gap between the transport rollers 52 and fall. The two rollers that constitute the transport rollers 52 correspond to an example of a pair of sheet driving portions according to the present disclosure.

When the sheet that has fallen is relatively long, only a portion of the sheet slides into the gap below the sheet tray 21, and an upper portion of the sheet remains in the transport path that extends in the vertical direction. Since the housing 11 has a door 14 on a wall surface along the transport path that extends in the vertical direction, the sheet that has fallen may be taken out by opening the door 14. However, if the gate unit 60 described below is not installed and a short sheet, such as a postcard-sized sheet, is used, the sheet may slip into the gap S below the sheet tray 21 over the entire length thereof.

If the sheet that has slipped into the gap S is not removed, there is a risk that the next sheet will come into contact with the sheet in the gap S and be wrinkled or bent. Therefore, when a sheet slips into the gap S, that sheet needs to be removed. If the sheet tray 21 is configured to be capable of being pulled out of and removed from the housing by the user, the user may remove the sheet as long as the user is aware that the sheet has slipped into the gap S. However, when a large number of large sheets are stacked on the sheet tray 21, removal of the sheet tray 21 is not easy and may be dangerous for the user. Therefore, in the present exemplary embodiment, the sheet tray 21 is not configured to be removable by the user. In addition, the bottom of the housing 11 is blocked by the bottom plate 111 for safety reasons, for example, to prevent fire. Therefore, once a sheet slips into the gap S, it becomes necessary to call a maintenance person. Accordingly, in the present exemplary embodiment, the gate unit 60 is disposed on the reversing transport path at a position above the bottom plate 111 of the housing 11 to prevent a sheet from slipping into the gap S.

Figure 2A:
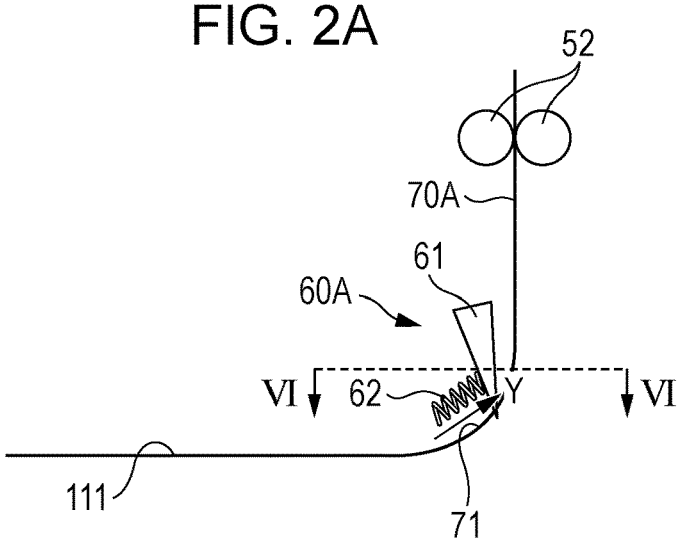
FIGS. 2A, 2B, and 2C are schematic diagrams illustrating a reversing transport path on which a first example of a gate unit is disposed.
Figure 2B:
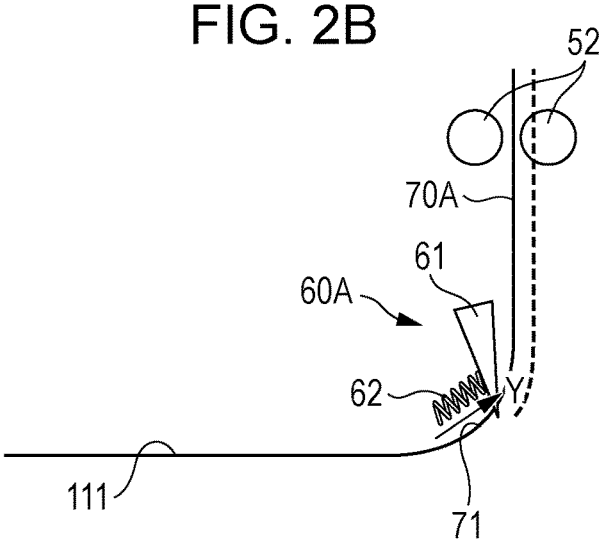
Figure 2C:
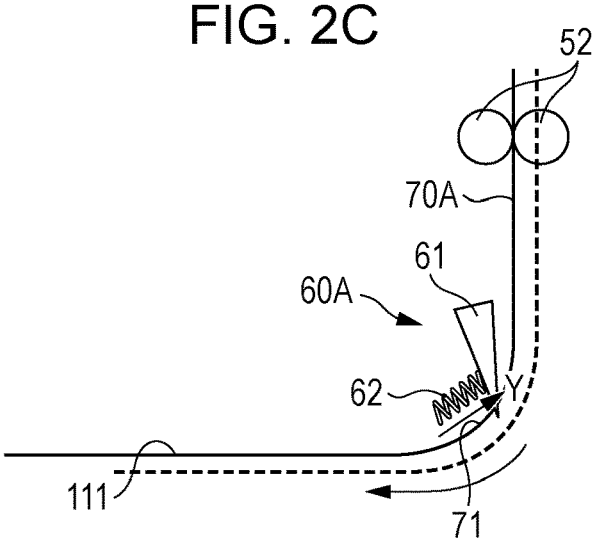

FIGS. 2A, 2B, and 2C are schematic diagrams illustrating the reversing transport path on which a first example of the gate unit is disposed.

As illustrated in FIG. 2A, the transport rollers 52 are disposed at the top of the reversing transport path. The sheet transported to the reversing transport path by the transport rollers 52 moves downward along a guide wall 70A. When the sheet is long in the transporting direction, the sheet is guided by a curved guide portion 71 at the bottom of the guide wall 70A and by the bottom wall 111 of the housing 11 (see FIG. 1), and enters the gap S (see FIG. 1).

The gate unit 60A is positioned to face the curved guide portion 71 at the bottom of the guide wall 70A. The gate unit 60A includes a gate member 61 made of a resin and a spring member 62 that presses the gate member 61 against the curved guide portion 71 of the guide wall 70A. In the present exemplary embodiment, the contact point between the gate member 61 and the guide wall 70A is on the curved guide portion 71, that is, at a position upstream of a horizontal surface of the bottom plate 111 in a downstream region in the transporting direction of the sheet transported to the reversing transport path by the transport rollers 52.

In FIG. 2B, the broken line shows the trajectory of a sheet that free falls. FIG. 2B illustrates the transport rollers 52 in an open state as a likely cause of falling of the sheet.

The spring member 62 presses the gate member 61 against the guide wall 70A (curved guide portion 71) with a force strong enough to prevent the gate member 61 from being opened by a force applied by the sheet that free falls.

Referring to FIG. 2C, the broken line shows the trajectory along which the sheet receiving a transport driving force from the transport rollers 52 is transported. Here, it is assumed that the sheet is long enough to enter the gap S (see FIG. 1). The spring force with which the spring member 62 presses the gate member 61 against the guide wall 70A (curved guide portion 71 of the guide wall 70A) is such that the gate member 61 may be pushed by the sheet receiving a transport driving force from the transport rollers 52. The sheet receiving a transport driving force from the transport rollers 52 pushes the gate member 61 and passes through the space between the guide wall 70A and the gate member 61.

Thus, the gate member 61 has a function of stopping the free falling sheet and allowing passage of the sheet receiving a transport driving force from the transport rollers 52.

The momentum of the free falling sheet is reduced by the curved guide portion 71. When the momentum of the falling sheet is reduced, passage of the sheet may be prevented simply by pressing the gate member 61 against the curved guide portion 71 with a weak force. The sheet that passes the gate member 61 has an image formed on the front side thereof that faces the guide wall 70A. Therefore, when the gate member 61 is pressed against the guide wall 70A with a strong force, there is a risk that the image will be damaged. Accordingly, the gate unit 60A is disposed at the curved guide portion 71, where the momentum of the falling sheet is reduced, so that the force with which the gate member 61 is pressed may be reduced. The gate member 61 corresponds to an example of a pressing member according to the present disclosure. The gate unit 60A corresponds to an example of a first gate unit according to the present disclosure. The curved guide portion 71 of the guide wall 70A corresponds to a curved guide portion of the present disclosure.

Figure 3A:
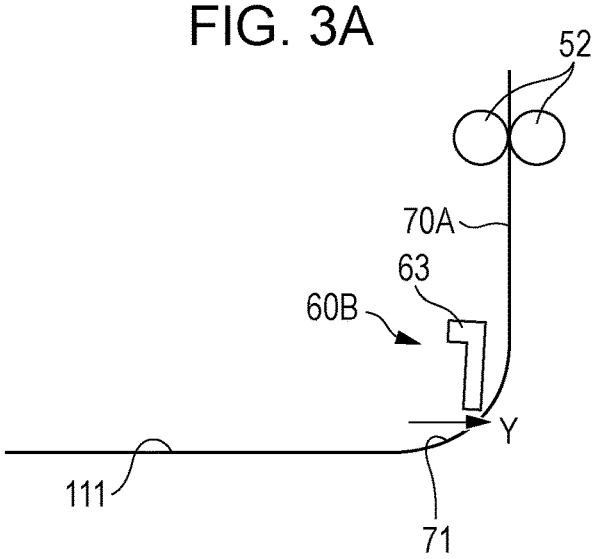
FIGS. 3A, 3B, and 3C are schematic diagrams illustrating the reversing transport path on which a second example of a gate unit is disposed.
Figure 3B:
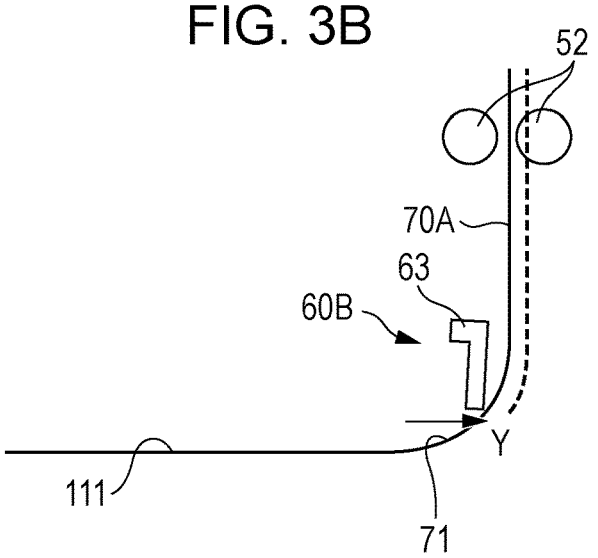
Figure 3C:
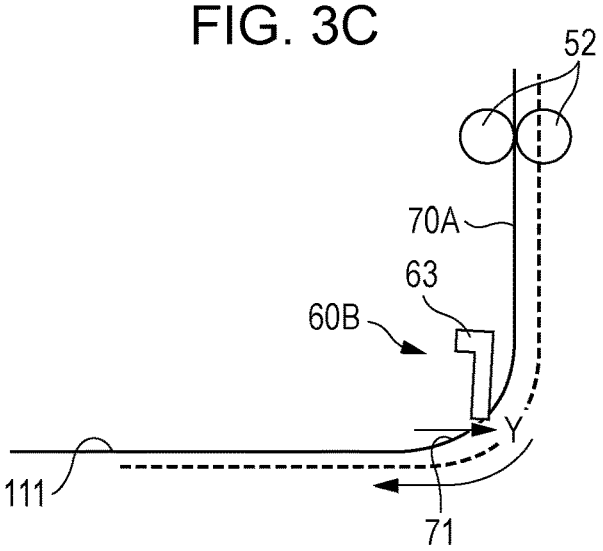

FIGS. 3A, 3B, and 3C are schematic diagrams illustrating the reversing transport path on which a second example of the gate unit is disposed. Only the differences from FIGS. 2A to 2C will be described.

FIGS. 3A to 3C illustrate a gate unit 60B including a gate member 63 formed of a PET film as the second example. This gate member 63 is pressed against the curved guide portion 71 of the guide wall 70A and elastically deformed. The pressing force applied to the guide wall 70A by the elastically deformed gate member 63 is adjusted to stop the free falling sheet and allow passage of the sheet receiving a transport driving force from the transport rollers 52.

According to the gate unit 60B of the second example, the gate member 63 is elastically deformed to generate a pressing force applied to the guide wall 70A. Therefore, no additional spring member is required to press the gate member 63. Thus, the gate unit has a simpler structure.

Figure 4A:
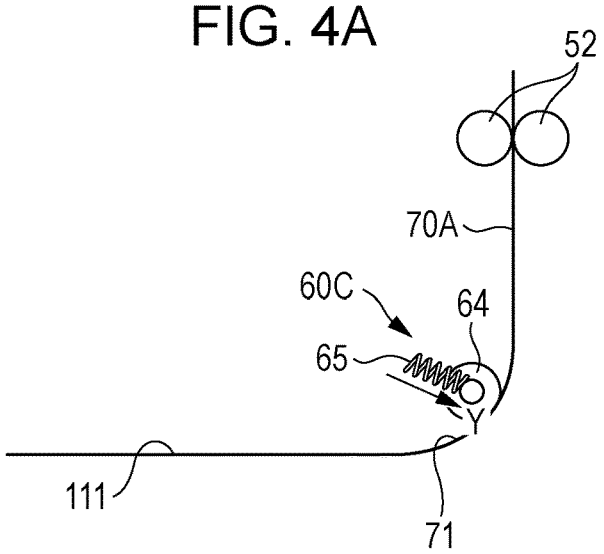
FIGS. 4A, 4B, and 4C are schematic diagrams illustrating the reversing transport path on which a third example of a gate unit is disposed.
Figure 4B:
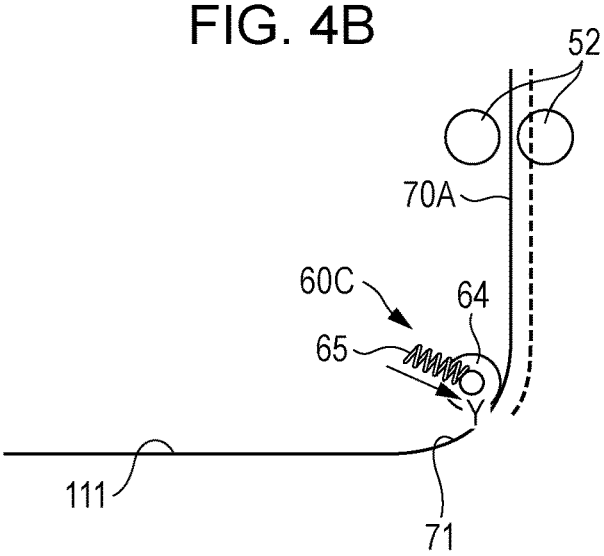
Figure 4C:
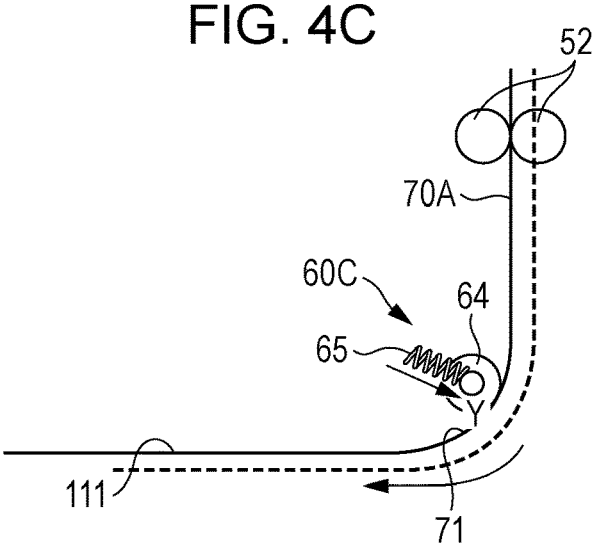

FIGS. 4A, 4B, and 4C are schematic diagrams illustrating the reversing transport path on which a third example of the gate unit is disposed. Only the differences from FIGS. 2A to 2C will be described.

FIGS. 4A to 4C illustrate a gate unit 60C including a gate member 64 and a spring member 65 as the third example. The gate member 64 is composed of a freely rotatable roller. The spring member 65 presses the gate member 64 against the curved guide portion 71 of the guide wall 70A. The pressing force with which the spring member 65 presses the gate member 64 against the guide wall 70A is adjusted to stop the free falling sheet and allow passage of the sheet receiving a transport driving force from the transport rollers 52.

According to the gate unit 60C of the third example, the roller that serves as the gate member 64 freely rotates. Therefore, damage to the sheet that passes the roller is further reduced.

In the above-described first to third examples, the guide wall 70A includes the curved guide portion 71 below a portion thereof that vertically extends. The curved guide portion 71 is disposed between the vertically extending portion and the bottom plate 111 of the housing that guides the sheet in a horizontal direction. However, an inclined surface may be provided instead of the curved guide portion 71.

Figure 5A:
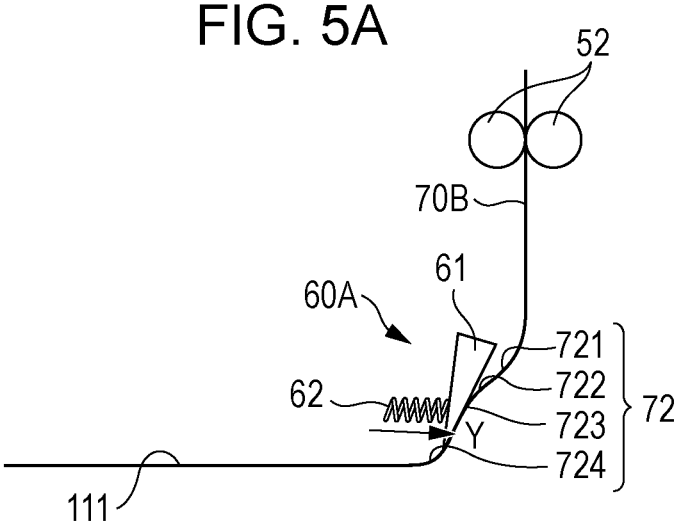
FIGS. 5A, 5B, and 5C are schematic diagrams illustrating a second example of a reversing transport path on which a gate unit is disposed.
Figure 5B:
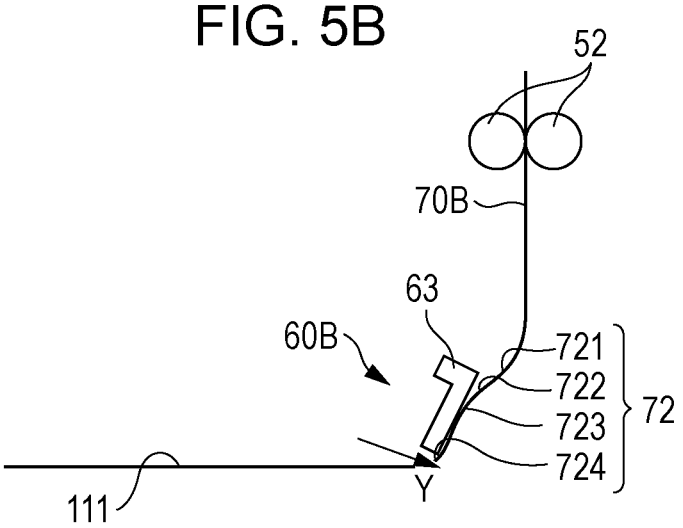
Figure 5C:
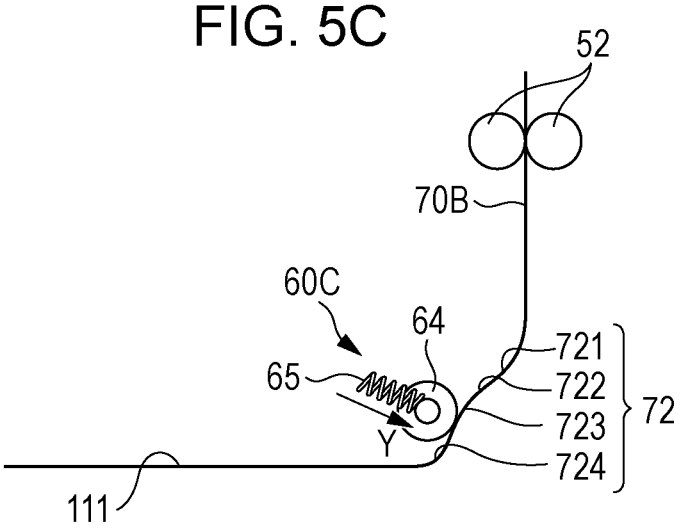

FIGS. 5A, 5B, and 5C are schematic diagrams illustrating a second example of the reversing transport path on which a gate unit is disposed. Only the differences from FIGS. 2A to 2C to FIGS. 4A to 4C will be described.

The guide wall 70A that defines the reversing transport path illustrated in FIGS. 2A to 2C to FIGS. 4A to 4C includes the curved guide portion 71 having a simple curved shape. FIGS. 5A to 5C illustrate a guide wall 70B including a curved guide portion 72 shaped as described below at a position corresponding to the position of the curved guide portion 71. The curved guide portion 72 illustrated in FIGS. 5A to 5C includes a first curved surface 721, a second curved surface 722, a gate receiving surface 723, and a third curved surface 724 in that order from an upstream side (upper side) in the downward transporting direction of the sheet that has entered the reversing transport path.

The first curved surface 721 is a guide surface that bends the sheet by guiding the front side of the sheet that is opposite to the back side facing toward the sheet tray 20 (leftward in FIGS. 5A to 5C), the sheet being bent such that the back side of the sheet faces inward. The second curved surface 722 is a guide surface that is disposed downstream of the first curved surface 721 and curved in a direction opposite to the direction in which the first curved surface 721 is curved. The gate receiving surface 723, which is connected to the second curved surface 722, is a surface against which a gate member, such as the gate member 61 illustrated in FIGS. 2A to 2C, is abutted. The third curved surface 724 is a guide surface that is disposed downstream of the gate receiving surface 723 and curved in the same direction as the direction in which the first curved surface 721 is curved.

The reversing transport path of the second example illustrated in FIGS. 5A to 5C is provided with the guide wall 70B including the curved guide portion 72 having the above-described shape.

FIGS. 5A, 5B, and 5C respectively illustrate the gate units 60A, 60B, and 60C illustrated in FIGS. 2A to 2C, FIGS. 3A to 3C, and FIGS. 4A to 4C. Referring to FIGS. 5A, 5B, and 5C, each of the gate members 61, 63, and 64 is positioned to face the gate receiving surface 723 and is abutted against the gate receiving surface 723.

The curved guide portion 72 of the guide wall 70B provided on the reversing transport path of the second example illustrated in FIGS. 5A to 5C includes the second curved surface 722 that is connected to the first curved surface 721 and curved in a direction opposite to the direction in which the first curved surface 721 is curved. Therefore, the momentum of the free falling sheet is greatly reduced by the first curved surface 721. The gate member, such as the gate member 61, is simply required to prevent passage of the sheet after the momentum thereof is greatly reduced. Accordingly, the pressing force applied to the gate member may be less than that in the case where the curved guide portion 71 illustrated in FIGS. 2A to 2C, for example, is provided, and damage to the sheet may be further reduced.

Figure 6A:
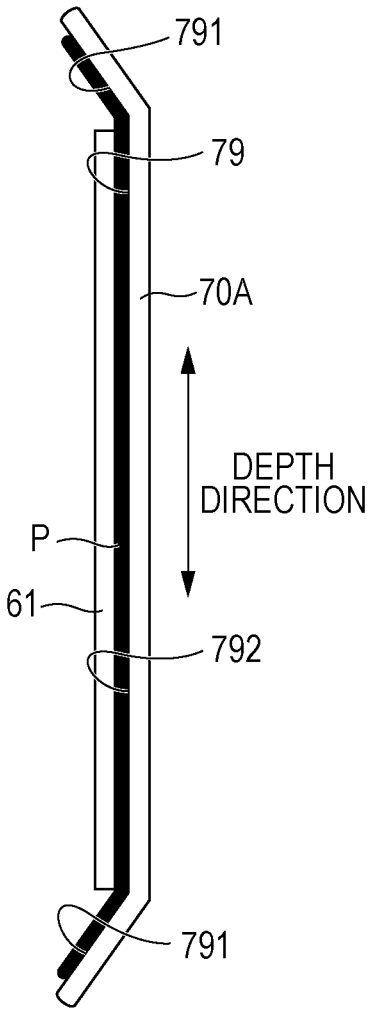
FIGS. 6A and 6B are sectional views taken along line VI-VI in FIG. 2A.
Figure 6B:
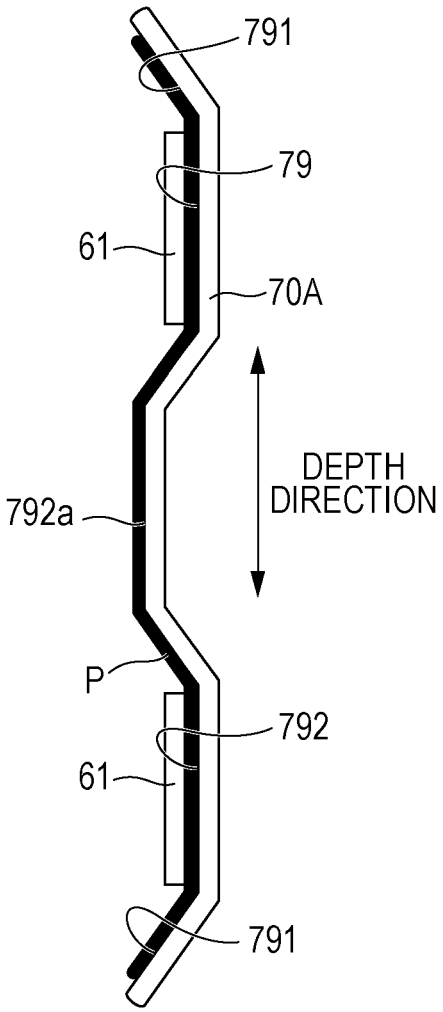

FIGS. 6A and 6B are sectional views taken along line VI-VI in FIG. 2A. FIG. 6A illustrates a first example, and FIG. 6B illustrates a second example. FIGS. 6A and 6B each illustrate an example of the guide wall 70A such that the vertical direction in FIGS. 6A and 6B is a depth direction that is perpendicular to the planes of FIG. 1 and FIGS. 2A to 2C.

FIGS. 6A and 6B each illustrate an example of the guide wall 70A, the sheet P, and the gate member 61. As described above, the guide wall 70A guides the front side of the sheet P. In the first example illustrated in FIG. 6A, the guide wall 70A includes a front-side guide surface 79 that guides the front side of the sheet P. The front-side guide surface 79 is shaped such that both end portions 791 thereof in the depth direction, that is, the width direction that crosses the direction in which the sheet moves, are closer to the sheet tray 20 (see FIG. 1) (leftward in FIG. 6A) than is a central region 792 excluding the end portions 791. Therefore, the sheet P guided by the front-side guide surface 79 is also shaped such that both end portions thereof in the width direction are bent. The gate member 61 is pressed against the front-side guide surface 79 in the central region 792, which is flat, and is pressed by the sheet P that tries to pass the gate member 61. At this time, since the sheet P is bent in the above-described shape, buckling of the sheet P is less likely to occur than when the sheet P has a simple flat shape. Therefore, the risk that the sheet P will buckle when the leading end thereof comes into contact with the gate member 61 and fail to pass the gate member 61 may be reduced.

In the second example illustrated in FIG. 6B, the front-side guide surface 79 of the guide wall 70A further includes a bulging portion 792*a* that bulges toward the sheet tray 20 in the central region 792. The gate member 61 is pressed against the front-side guide surface 79 in portions of the central region 792 excluding the bulging portion 792*a*.

When not only the end portions of the sheet P in the width direction but also the central portion of sheet P is shaped as described above, buckling of the sheet P is even less likely to occur. Therefore, the risk that the sheet P will buckle and fail to pass the gate member 61 may be further reduced.

Although an example of the guide wall 70A is illustrated in each of FIGS. 6A and 6B, the above discussion may also be applied to the guide wall 70B illustrated in FIGS. 5A to 5C.

Figure 7:
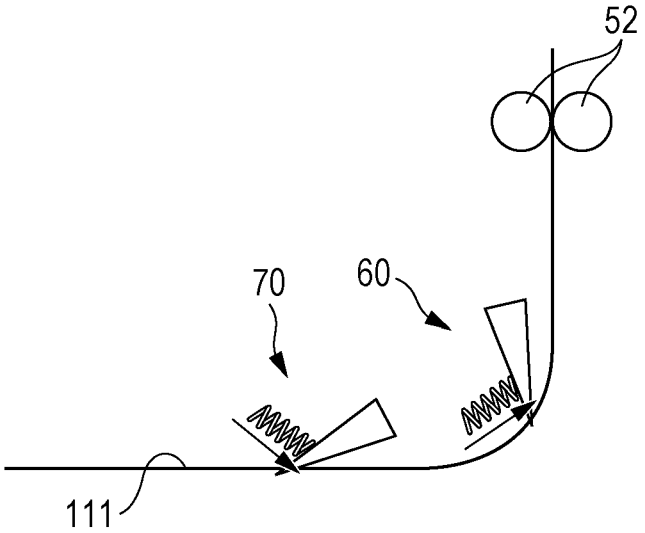
FIG. 7 is a schematic diagram illustrating a reversing transport path on which two gate units are disposed.

FIG. 7 is a schematic diagram illustrating a reversing transport path on which two gate units are disposed.

The reversing transport path illustrated in FIG. 7 is provided with the gate unit 60 illustrated in, for example, FIGS. 2A to 2C and another gate unit 70 disposed downstream of the gate unit 60 in the direction in which the sheet that has entered the reversing transport path moves. This gate unit 70 also allows passage of the sheet receiving a transport driving force from the transport rollers 52 and prevents passage of the sheet that moves without receiving a transport driving force from the transport rollers 52.

For example, assume that a somewhat long sheet that receives a transport driving force from the transport rollers 52 is transported downward and that the leading end thereof has passed the first gate unit 60. At this time, assume that the transport rollers 52 are opened due to any reason, such as noise, and the sheet starts to free fall. In such a case, since the sheet has already passed the gate unit 60, the sheet that has started to free fall does not stop and continues to fall. If the sheet is sufficiently long, even when the leading end portion of the free falling sheet slips into the gap S, the trailing end portion of the sheet appears when the door 14 illustrated in FIG. 1 is opened. Therefore, the sheet may be removed. However, if the sheet is not long enough, when the sheet starts to free fall after the leading end thereof has passed the first gate unit 60, the sheet may slip into the gap S over the entire length thereof including the trailing end unless the second gate unit 70 is installed.

In the example illustrated in FIG. 7, the second gate unit 70 is installed. When the sheet is somewhat long, the sheet transporting direction is reversed before the leading end of the sheet passes the second gate unit 70 in a normal operation. Therefore, if the somewhat long sheet free falls, the sheet is stopped by the second gate unit 70. Accordingly, when the door 14 is opened, the trailing end portion of the sheet appears, and the sheet may be removed. However, if the second gate unit 70 is installed but the first gate unit 60 is removed, a very short sheet, such as a postcard-sized sheet, may slip into the gap S over almost the entire length thereof including the trailing end portion of the sheet even when the sheet is stopped by the second gate unit 70. In such a case, the sheet cannot be removed by opening the door 14. Therefore, when the apparatus has such a risk, the second gate unit 70 may be installed in addition to the first gate unit 60 to reliably reduce the risk that the sheet will slip into the gap S and cannot be removed.

In the present exemplary embodiment, three examples of a gate unit according to the present disclosure have been described: an example in which the gate member 61 made of a resin is used, an example in which the gate member 63 composed of a PET film is used, and an example in which the gate member 64 composed of a roller is used. However, the gate unit according to the present disclosure is not limited to these examples, and may have any structure as long as the gate unit prevents passage of a sheet when the sheet free falls and allows passage of the sheet when the sheet receives a transport driving force.

Although an image forming apparatus that forms an image by an electrophotographic method and a sheet transport device installed in the image forming apparatus are described, the image forming apparatus according to the present disclosure may be an image forming apparatus that forms an image by a method other than the electrophotographic method, such as an inkjet method. Also, the sheet transport device according to the present disclosure may be a sheet transport device installed in an image forming apparatus that forms an image by a method other than the electrophotographic method. Also, the sheet transport device according to the present disclosure may be applied to a sheet transport device installed in an apparatus that is other than an image forming apparatus and in which a sheet needs to be reversed.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sheet transport device comprising:

a sheet storage unit that stores a sheet and that is disposed in a housing having a bottom plate such that a gap is provided between the sheet storage unit and the bottom plate, the gap extending horizontally;

a sheet transport unit that feeds the sheet from the sheet storage unit and transports the fed sheet along a transport passage including a reversing transport path along which the sheet is transported downward and then upward to reverse the sheet front to back, the reversing transport path extending vertically and being connected to the gap; and a first gate unit that prevents passage of the sheet that has entered the reversing transport path, and the first gate unit does not open by a force of the sheet when the sheet free falls, and allows passage of the sheet when the first gate unit is pushed by the sheet receiving a sheet transport driving force from the sheet transport unit.

2. The sheet transport device according to claim 1, further comprising:

a sheet guide unit having a front-side guide surface that guides a front side of the sheet, the front side being opposite to a back side of the sheet facing the sheet storage unit, the front-side guide surface being shaped such that end portions thereof in a width direction that crosses a direction in which the sheet moves are closer to the sheet storage unit than is a central region of the front-side guide surface excluding the end portions, wherein the first gate unit is pressed against the front-side guide surface in the central region and allows passage of the sheet between the first gate unit and the front-side guide surface when the sheet receives the sheet transport driving force from the sheet transport unit.

3. The sheet transport device according to claim 2, wherein the front-side guide surface includes a bulging portion in addition to the end portions, the bulging portion being provided in the central region and bulging toward the sheet storage unit, and wherein the first gate unit is pressed against the front-side guide surface in a portion of the central region excluding the bulging portion.

4. The sheet transport device according to claim 3, further comprising:

a second gate unit disposed downstream of the first gate unit in a direction in which the sheet that has entered the reversing transport path moves, the second gate unit allowing passage of the sheet when the sheet receives the sheet transport driving force from the sheet transport unit and preventing passage of the sheet when the sheet moves without receiving the sheet transport driving force.

5. The sheet transport device according to claim 3, wherein the sheet transport unit includes a pair of sheet driving portions that support the sheet therebetween in a releasable manner, the pair of sheet driving portions transporting the sheet downward into the reversing transport path and removing the sheet from the reversing transport path by transporting the sheet that has entered the reversing transport path upward.

6. The sheet transport device according to claim 2, further comprising:

a second gate unit disposed downstream of the first gate unit in a direction in which the sheet that has entered the reversing transport path moves, the second gate unit allowing passage of the sheet when the sheet receives the sheet transport driving force from the sheet transport unit and preventing passage of the sheet when the sheet moves without receiving the sheet transport driving force.

7. The sheet transport device according to claim 2, wherein the sheet transport unit includes a pair of sheet driving portions that support the sheet therebetween in a releasable manner, the pair of sheet driving portions transporting the sheet downward into the reversing transport path and removing the sheet from the reversing transport path by transporting the sheet that has entered the reversing transport path upward.

8. The sheet transport device according to claim 1, further comprising:

a second gate unit disposed downstream of the first gate unit in a direction in which the sheet that has entered the reversing transport path moves, the second gate unit allowing passage of the sheet when the sheet receives the sheet transport driving force from the sheet transport unit and preventing passage of the sheet when the sheet moves without receiving the sheet transport driving force.

9. The sheet transport device according to claim 1, wherein the sheet transport unit includes a pair of sheet driving portions that support the sheet therebetween in a releasable manner, the pair of sheet driving portions transporting the sheet downward into the reversing transport path and removing the sheet from the reversing transport path by transporting the sheet that has entered the reversing transport path upward.

10. An image forming apparatus comprising:

the sheet transport device according to claim 1, wherein an image is formed on the sheet that is being transported by the sheet transport unit.

11. A sheet transport device comprising:

a sheet storage unit that stores a sheet and that is disposed in a housing having a bottom plate such that a gap is provided between the sheet storage unit and the bottom plate, the gap extending horizontally;

a sheet transport unit that feeds the sheet from the sheet storage unit and transports the fed sheet along a transport passage including a reversing transport path along which the sheet is transported downward and then upward to reverse the sheet front to back, the reversing transport path extending vertically and being connected to the gap; and a first gate unit that prevents passage of the sheet that has entered the reversing transport path when the sheet free falls, and allows passage of the sheet when the sheet receives a sheet transport driving force from the sheet transport unit, wherein the first gate unit is disposed on a curved guide portion that, to guide the sheet toward the gap, bends the sheet that has entered the reversing transport path and that has been transported downward, the sheet receiving a sheet transport driving force from the sheet transport unit passes through a space between a guide wall and the first gate unit.

12. The sheet transport device according to claim 11, wherein the curved guide portion includes a first curved surface that bends the sheet that has entered the reversing transport path by guiding a front side of the sheet, the front side being opposite to a back side of the sheet facing the sheet storage unit, the sheet being bent such that the back side of the sheet faces inward, a second curved surface disposed downstream of the first curved surface in a direction in which the sheet moves, the second curved surface being curved in a direction opposite to a direction in which the first curved surface is curved, and a third curved surface disposed downstream of the second curved surface such that a gate receiving surface is provided between the second curved surface and the third curved surface, the third curved surface being curved in same direction as the direction in which the first curved surface is curved, and wherein the first gate unit is pressed against the gate receiving surface and allows passage of the sheet between the first gate unit and the gate receiving surface when the sheet receives the sheet transport driving force from the sheet transport unit.

13. The sheet transport device according to claim 12, further comprising:

a second gate unit disposed downstream of the first gate unit in a direction in which the sheet that has entered the reversing transport path moves, the second gate unit allowing passage of the sheet when the sheet receives the sheet transport driving force from the sheet transport unit and preventing passage of the sheet when the sheet moves without receiving the sheet transport driving force.

14. The sheet transport device according to claim 12, wherein the sheet transport unit includes a pair of sheet driving portions that support the sheet therebetween in a releasable manner, the pair of sheet driving portions transporting the sheet downward into the reversing transport path and removing the sheet from the reversing transport path by transporting the sheet that has entered the reversing transport path upward.

15. The sheet transport device according to claim 11, further comprising:

a second gate unit disposed downstream of the first gate unit in a direction in which the sheet that has entered the reversing transport path moves, the second gate unit allowing passage of the sheet when the sheet receives the sheet transport driving force from the sheet transport unit and preventing passage of the sheet when the sheet moves without receiving the sheet transport driving force.

16. The sheet transport device according to claim 11, wherein the sheet transport unit includes a pair of sheet driving portions that support the sheet therebetween in a releasable manner, the pair of sheet driving portions transporting the sheet downward into the reversing transport path and removing the sheet from the reversing transport path by transporting the sheet that has entered the reversing transport path upward.

17. A sheet transport device comprising:

a sheet storage unit that stores a sheet and that is disposed in a housing having a bottom plate such that a gap is provided between the sheet storage unit and the bottom plate, the gap extending horizontally;

a sheet transport unit that feeds the sheet from the sheet storage unit and transports the fed sheet along a transport passage including a reversing transport path along which the sheet is transported downward and then upward to reverse the sheet front to back, the reversing transport path extending vertically and being connected to the gap below the sheet storage unit; and a pressing member that is pressed against a guide wall that guides the sheet, the pressing member is pressed against the guide wall by an elastic member, and the pressing member is pushed away from the guide wall by the sheet receiving a sheet transport driving force from the sheet transport unit.

18. The sheet transport device according to claim 17, wherein a contact point between the guide wall and the pressing member is located downstream of a vertical surface of the guide wall in a transporting direction of the sheet that is transported into the reversing transport path, and the sheet that is transported passes the contact point and is then reversed.

19. The sheet transport device according to claim 18, wherein the contact point is located upstream of a horizontal surface of the bottom plate in the transporting direction.

20. The sheet transport device according to claim 17, wherein a contact point between the guide wall and the pressing member is located on a curved or inclined surface of the guide wall, and the sheet that is transported passes the contact point and is then reversed.

* * * * *